US009203199B2

(12) United States Patent
Brown

(10) Patent No.: US 9,203,199 B2
(45) Date of Patent: Dec. 1, 2015

(54) WATERPROOF SEPARABLE SWIVEL CONNECTOR

(71) Applicant: Aqua Products, Inc., Cedar Grove, NJ (US)

(72) Inventor: Keith Brown, Montclair, NJ (US)

(73) Assignee: Aqua Products, Inc., Cedar Grove, NJ (US)

( * ) Notice: Subject to any disclaimer, the term of this patent is extended or adjusted under 35 U.S.C. 154(b) by 72 days.

(21) Appl. No.: 13/965,597

(22) Filed: Aug. 13, 2013

(65) Prior Publication Data

US 2014/0273540 A1 Sep. 18, 2014

Related U.S. Application Data

(60) Provisional application No. 61/788,162, filed on Mar. 15, 2013.

(51) Int. Cl.

| | |
|---|---|
| ***H01R 39/00*** | (2006.01) |
| ***H01R 39/64*** | (2006.01) |
| ***H01R 13/523*** | (2006.01) |
| *H01R 13/627* | (2006.01) |
| *H01R 24/58* | (2011.01) |

(52) U.S. Cl.

CPC ..... *H01R 39/64* (2013.01); *H01R 13/523* (2013.01); *H01R 13/6275* (2013.01); *H01R 24/58* (2013.01)

(58) Field of Classification Search

CPC .... H01R 39/64; H01R 35/04; H01R 2103/00; H01R 39/643; H01R 13/652

USPC ..... 439/13

See application file for complete search history.

(56) References Cited

U.S. PATENT DOCUMENTS

| | | | | | |
|---|---|---|---|---|---|
| 1,537,639 | A | * | 5/1925 | Johnson | 439/28 |
| 1,743,118 | A | * | 1/1930 | Couture et al. | 439/21 |
| 1,749,702 | A | * | 3/1930 | Goucher et al. | 439/28 |
| 2,476,398 | A | * | 7/1949 | Baumann | 439/17 |
| 2,542,935 | A | * | 2/1951 | McElroy | 439/27 |
| 2,624,602 | A | * | 1/1953 | Dupre | 403/371 |
| 3,234,317 | A | * | 2/1966 | Henderson | 174/15.7 |
| 3,591,889 | A | * | 7/1971 | Wisher | 15/321 |
| 4,009,896 | A | * | 3/1977 | Brewer | 285/305 |
| 4,123,133 | A | * | 10/1978 | Pickett et al. | 439/863 |
| 4,135,745 | A | * | 1/1979 | Dehar | 285/319 |
| 4,219,222 | A | * | 8/1980 | Brusadin | 285/8 |
| 4,266,814 | A | * | 5/1981 | Gallagher | 285/319 |
| 4,488,139 | A | * | 12/1984 | Snider, Jr. | 439/23 |
| 4,550,958 | A | * | 11/1985 | Smith | 439/13 |

(Continued)

*Primary Examiner* — Abdullah Riyami
*Assistant Examiner* — Vladimir Imas
(74) *Attorney, Agent, or Firm* — Abelman, Frayne & Schwab

(57) ABSTRACT

The disclosure relates to a cable grasping assembly and an associated waterproof lockable disengaging swiveling electrical cable connector housing structure. The assembly includes and end cap, a cable-holding sleeve and a housing. The end cap threads onto the housing in such a way that it causes fingers of the housing to compress the cable holding sleeve onto a cable which passes through the bores of all three. The structure includes a male housing partially inserted into the bore of a female housing. Each housing has a generally cylindrical body with a cable support structure located within its bore. The two housings are free to rotate about the cylindrical surfaces of each other when locked together via a locking sleeve. The structure also includes a sealing structure carried by one of the housings that establishes a watertight seal between the housings when the male is partially inserted into the female.

20 Claims, 8 Drawing Sheets

(56) References Cited

U.S. PATENT DOCUMENTS

| | | | | | |
|---|---|---|---|---|---|
| 4,557,535 | A * | 12/1985 | Keane | 439/13 |
| 4,705,304 | A * | 11/1987 | Matsuda et al. | 285/243 |
| 4,909,741 | A * | 3/1990 | Schasteen et al. | 439/13 |
| 4,936,544 | A * | 6/1990 | Bartholomew | 251/149.6 |
| 5,111,129 | A * | 5/1992 | Schuman | 320/107 |
| 5,354,106 | A * | 10/1994 | Washizu et al. | 285/319 |
| 5,413,387 | A * | 5/1995 | Bartholomew | 285/319 |
| 5,626,371 | A * | 5/1997 | Bartholomew | 285/319 |
| 5,782,508 | A * | 7/1998 | Bartholomew | 285/319 |
| 6,010,348 | A * | 1/2000 | Alden | 439/274 |
| 6,190,180 | B1 * | 2/2001 | Purington et al. | 439/17 |
| 6,494,203 | B1 * | 12/2002 | Palmer | 128/202.27 |
| 6,500,170 | B2 * | 12/2002 | Palmer et al. | 606/1 |
| 6,582,420 | B2 * | 6/2003 | Castaneda et al. | 606/1 |
| 7,052,297 | B2 * | 5/2006 | Panzar et al. | 439/169 |
| 7,344,166 | B2 * | 3/2008 | Ketcham et al. | 285/319 |
| 7,467,813 | B2 * | 12/2008 | Gunderson | 285/319 |
| 7,484,696 | B2 * | 2/2009 | Kim | 248/49 |
| 7,537,457 | B2 * | 5/2009 | Rashkover | 439/13 |
| 7,549,677 | B2 * | 6/2009 | Feger et al. | 285/12 |
| 7,766,393 | B2 * | 8/2010 | Tiberghien et al. | 285/317 |
| 8,215,962 | B1 * | 7/2012 | Machado | 439/18 |
| 8,366,154 | B2 * | 2/2013 | Wang | 285/314 |
| 8,631,881 | B2 * | 1/2014 | Olson et al. | 175/19 |
| 8,696,037 | B2 * | 4/2014 | Nakamura | 285/315 |

* cited by examiner

WATERPROOF SEPARABLE SWIVEL CONNECTOR

CROSS-REFERENCE TO RELATED PATENT APPLICATIONS

This application is a Non-Provisional Application claiming priority to the U.S. Provisional Application No. 61/788,162, filed Mar. 15, 2013, entitled "SWIVEL CONNECTOR", of which is incorporated herein by reference in its entirety.

BACKGROUND

There are robotic cleaning vehicles for liquid filled containers that are connected to an electrical power source by a cable. These vehicles often follow tortuous paths of travel in accomplishing their cleaning missions and this results in torsional stress building up in the cables as they twist to accommodate the motion of the vehicles. This torsional stress can be somewhat relieved if segments of the cables rotate with respect to other segments of the same cables. This can be facilitated by inserting swivel joints into the cables. However, such joints need to ensure good electrical contact between the cable segments, isolate the electrical contacts from the liquid in which the vehicles are immersed when in operation and prevent the separation of the cable segments from each other when an axial force is applied to the cable segments. It would also be helpful if the segments of a cable could be readily disconnected from each other at a location between the power source and the vehicle when the vehicle is not in operation. One approach is to effect the electrical connection between the cable segments using a classical stereo jack and socket that has been modified by the placement of an O-ring to isolate the electrical contacts from the immersion liquid. For instance, the socket and the jack can be extended to provide for a groove to accommodate an O-ring in one of them that is distal from the tip of the jack when it is inserted in the socket. Such an arrangement is inadequate to resist the axial forces typically experienced by the cable segments when there is not some other structure to isolate the joint from these axial forces. One such structure is a rigid right angle elbow that encompasses a cable segment but it does not always operate to allow relief of the torsional stress from the movement of the vehicle as efficiently as is desired.

SUMMARY

One embodiment involves a cable grasping assembly having an end cap with a bore with a decreasing diameter from one end to the other, a cable holding sleeve constructed of a readily compressible material and a housing with an interior bore for accommodating a cable. The end cap has a screw thread on the interior surface of its bore and a ledge that projects inward from the interior surface of the bore adjacent to the end with the smallest diameter. The cable holding sleeve has a generally circular bore which extends over its axial length, a series of ridges which extend radially from its outer surface and which extend axially over a significant portion of its axial length and a collar at one end beyond the axial terminus of the ridges which extends radially from the outer surface of the sleeve. The housing has a series of fingers which extend from one end of the housing with gaps between them to accommodate the ridges of the cable holding sleeve and which have an axial length such that their free ends terminate at the collar of cable holding sleeve and a screw thread on the exterior surface of the housing and spaced from the free end of the fingers.

Another embodiment also involves a waterproof lockable disengaging swiveling electrical cable connector housing structure having a first housing having a cable support structure located within its bore for receiving a first electrical cable segment, a second housing having a cable support structure located within its bore for receiving having a second electrical cable segment and a locking sleeve operatively slidingly secured to the second housing and movable from a first position to a second position to lock the first housing to the second housing, such that the first housing is rotatable relative to the second housing when the locking sleeve is in the locked position.

In other embodiments the structure includes a male housing partially inserted into the bore of a female housing. Each housing has a generally cylindrical body with a cable support structure located within its bore. It also has an interior cylindrical recess to accommodate a cable grasping sleeve, with this recess being located adjacent to the end of the housing distal from the end involved in the partial insertion. Each housing has additionally has an engagement structure for engaging a reciprocal engagement structure on the other housing in such a way that the two housings are free to rotate about the cylindrical surfaces of each other when locked together via their engagement structures and a locking sleeve. It further has a mechanism for affixing an end cap over the exterior surface of the housing which is located adjacent to the end of the housing carrying the recess for a cable sealing sleeve. The structure also includes a sealing structure carried by one of the housings which establishes a water tight seal between the housings when the male is partially inserted into the female and a cable grasping sleeves seated in their recess the housings and constructed of a compressible material. The structure further includes two end caps, each with a mechanism which interacts with the mechanism on one of the housings to affix the end cap to the housing in such a way that the interior diameter of the cable grasping sleeve seated in the housing is decreased and each end cap having an aperture which aligns with the cable support structure located within the bore of its housing. The structure additionally includes a locking sleeve which is manually moveable into and out of interaction with the engagement structures of the two housings such that as a result of the interaction they are locked into engagement and in this locked configuration do not allow axial movement between the two housings.

A further aspect of the embodiments also involves a method of connecting an electrical power cable to a robotic cleaning vehicle for a liquid filled container by providing one electrical cable segment attached to the vehicle and another attached to a power source, equipping the free end of one cable with a classic stereo jack and the free end of the other cable with a classic stereo socket and inserting these free ends into the axially opposed ends of a waterproof lockable disengaging swiveling electrical cable connector housing structure described above such that the jack becomes will become seated in the socket to create two circuit paths when the housing is assembled. The method further involves affixing the end caps of the housing structure on their respective housings such that that housing's cable grasping sleeve grasps the cable segment inserted through its end cap, inserting the male housing into the female housing such that the jack affixed to one cable segment becomes will become seated in the socket affixed to the other cable segment to create two circuit paths and moving the locking sleeve to interact with the engagement structures of the two housings such that the two cable segments are securely held together against any axial force but are free to rotate with respect to each other.

DETAILED DESCRIPTION

Figure 1:
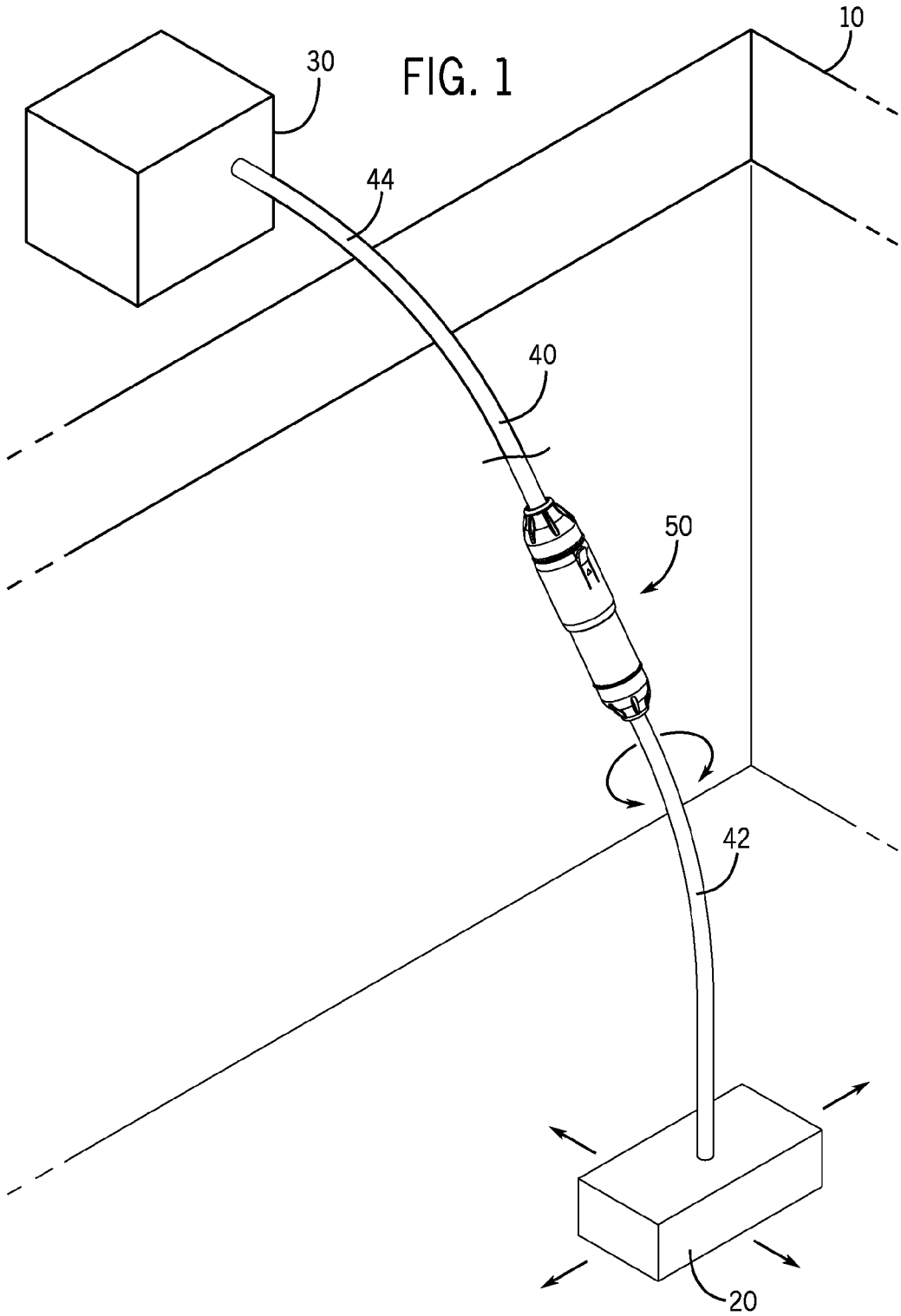
FIG. 1 is an isometric schematic illustration of a liquid containing vessel with a robotic cleaning vessel on its floor connected to an electrical power source via a cable with a swivel connector.

Referring to FIG. 1, the environment of the present invention is illustrated with a liquid containment vessel 10 submerged in which is a robotic cleaning vehicle 20 connected to an electrical power source 30 by an electrical supply cable 40 whose segments 42 and 44 are joined by a cable connector housing structure 50.

Figure 2:
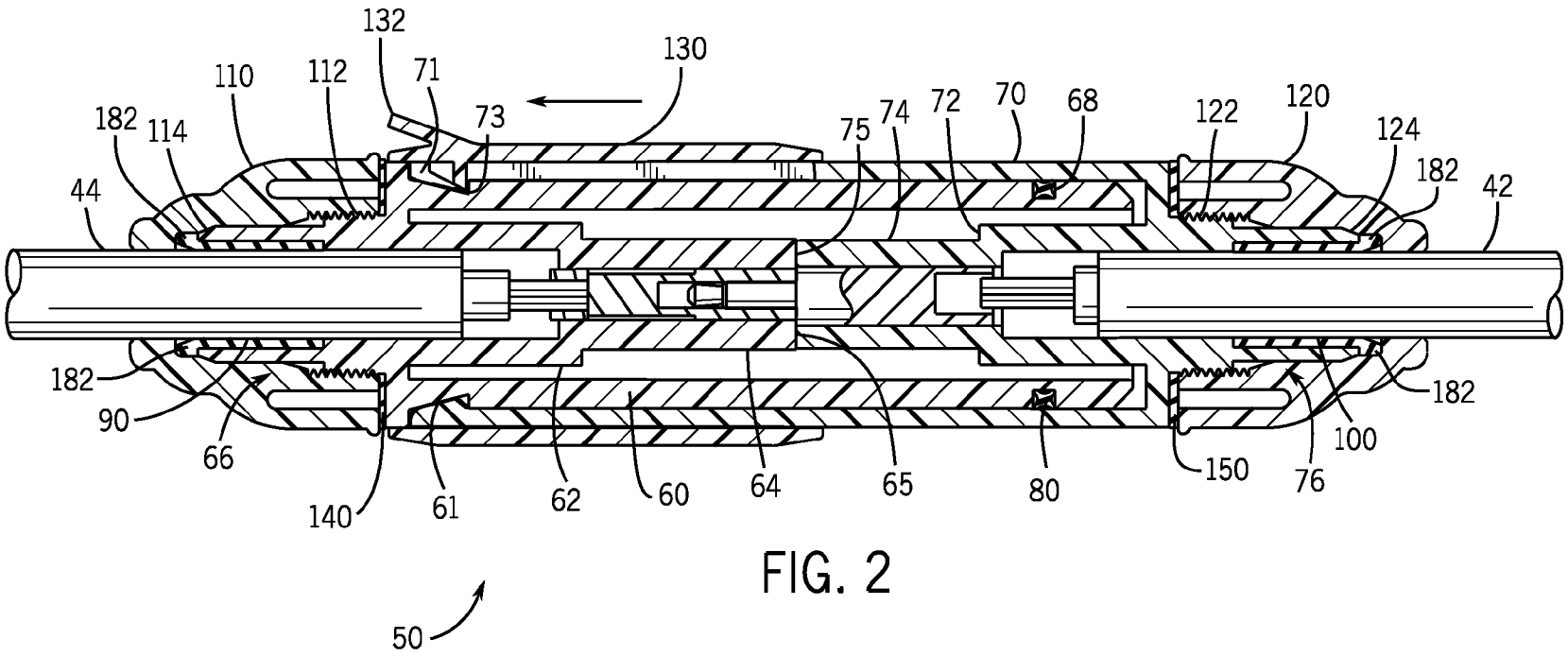
FIG. 2 is a cross section of a locked assembled cable connector housing structure.

Referring to FIG. 2, one embodiment involves a cable connector housing structure 50 which has a male housing 60 which is partially inserted into a female housing 70. The male housing 60 carries a series of detents 61 on its outside surface arranged to provide an unobstructed circular path. The female housing 70 carries a series of protuberances 71 which engage the detents 61 thus holding the two housings 60 and 70 together against axial displacement. These protuberances 71 have a sloped rear surface 73 which allows them to be drawn out of the detents 61 upon the application of an axial separating force provided that their ability to move in the radial direction away from the axis of the housings 60 and 70 is not inhibited. The housings 60 and 70 each have a cable support structure 62 and 72, respectively. These structures 62 and 72 serve to support the cable segments 44 and 42, respectively, when the cable segments 44 and 42 are inserted into the housings 60 and 70. The cable support structures 62 and 72 each have an inner bore 64 and 74, respectively, and each of these has an end 65 and 75, respectively. These inner bore ends 65 and 75 are touching thus providing support for the ends of the cable segments 44 and 42. The housings 60 and 70 carry recesses 66 and 76, respectively, which carry cable grasping sleeves 90 and 100, respectively. These sleeves 90 and 100 are constructed of a compressible material and have corrugations about their circumference running in the axial direction to aid in their grasping the cable segments 44 and 42. The male housing 60 carries a groove 68 in which is an O-ring 80 to provide a water tight seal between the two housings 60 and 70. In one embodiment a four-lobed X-ring is used instead of the O-ring. X-rings are commercially available as Quad-Ring® seals. End caps 110 and 120 are threaded on housings 60 and 70 by their female screw threads 112 and 122, respectively. These end caps 110 and 120 have inclined surfaces 114 and 124, respectively, which press against the grasping sleeves 90 and 100, respectively, causing them to firmly grasp the cable segments 44 and 42, respectively. A locking sleeve 130 is in position over the protuberances 71 preventing them from moving in the radial direction away from the axis of the housings 60 and 70 and being drawn out of the detents 61 by their sloped rear surfaces 73 upon the application of an axial separating force. The locking sleeve 130 is provided with a release tab 132 which facilitates taking it out of engagement with a detent 61 in the male housing 60 when it is desired to move the locking sleeve 130 to an unlocked position. The end caps 110 and 120 seat against rubber washers 140 and 150, respectively.

Figure 3:
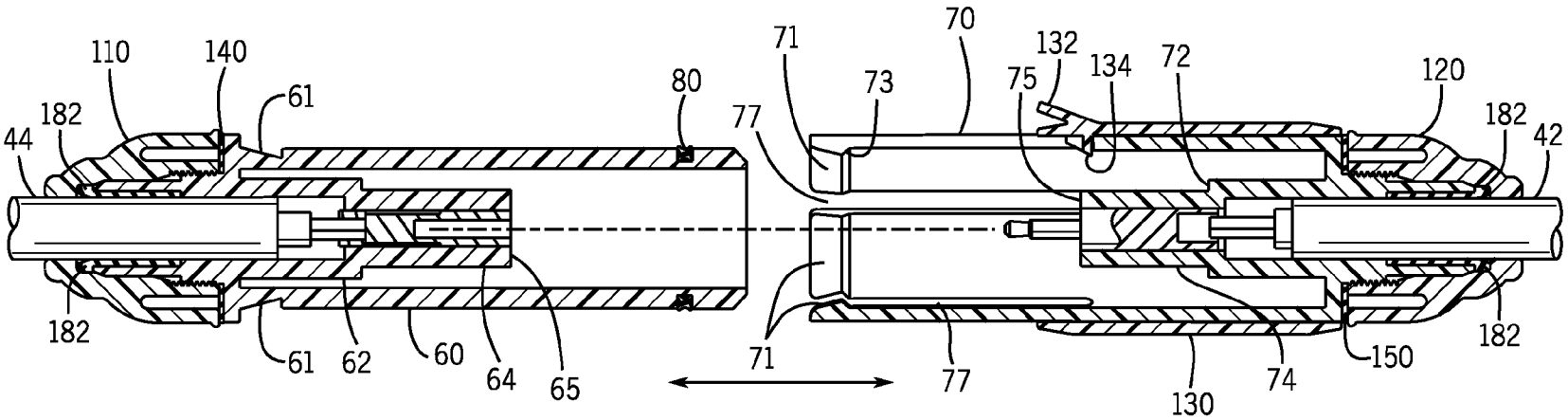
FIG. 3 is a cross section of a disassembled cable connector housing structure.

Referring to FIG. 3, one embodiment involves the two housings 60 and 70 being separated from each other. The locking sleeve 130 is therefore in its unlocked position and the protuberances 71 of the female housing 70 are not seated in the detents 61 of the male housing 70. The other elements are as they were in FIG. 2 except that the inner bore ends 65 and 75 no longer touch. In one embodiment the outside cylindrical body of the female housing 70 has axial slots 77 which facilitate the radial movement of its protuberances 71 into and out of engagement with the detents 61 of the male housing 60. One of these slots 77 aligns with the protuberance 134 carried by locking sleeve 130 allowing this protuberance 134 to engage one of the detents 61 in the male housing 60.

Figure 4:
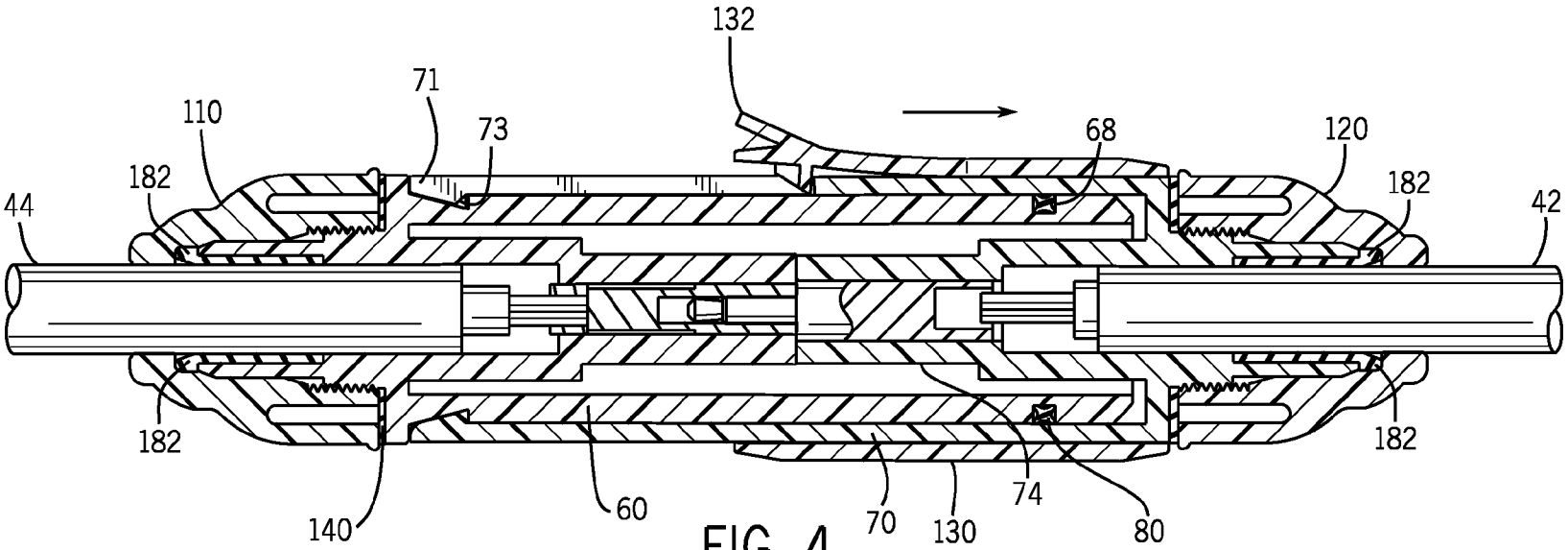
FIG. 4 is a cross section of an unlocked assembled cable connector housing structure.

Referring to FIG. 4, one embodiment involves the male housing 60 partially inserted into the female housing 70, as in FIG. 2 but with the locking sleeve 130 in its unlocked position. This is the configuration intermediate between those shown in FIG. 2 and FIG. 3. It is the configuration just after the male housing 60 is inserted into the female housing 70 or just before the male housing 60 is withdrawn from the female housing 70 by the application of an axial force which draws the protuberances 71 out of the detents 61 by a sliding and lifting action facilitated by the sloped rear surfaces 73.

Figure 5:
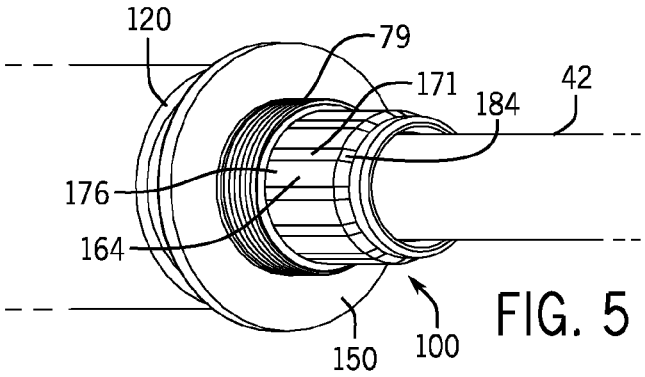
FIG. 5 is an isometric view of grasping fingers on an exterior end of a housing that is a part of a cable connector housing structure.

Referring to FIG. 5, one embodiment involves the female housing 120 equipped with fingers 164 which interact with the ribs 171 of its cable-grasping sleeve 100. The fingers 164 extend outward from the housing's male threads 79. The fingers 164 have outer surface 176. The ribs 171 have an inward taper 184.

Figure 6:
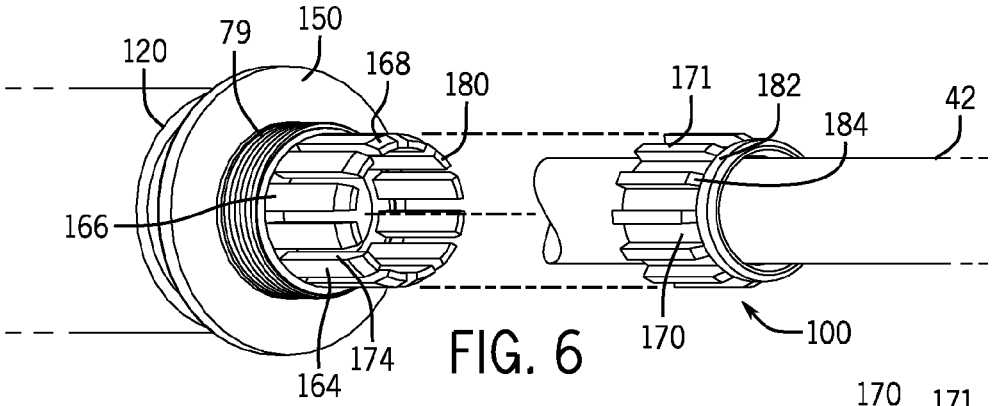
FIG. 6 is an isometric view of grasping fingers on an exterior end of a housing that is a part of a cable connector housing structure and a cable grasping sleeve mounted on a cable segment.

Referring to FIG. 6, this embodiment involves the fingers 164 having a secured end 166 adjacent to the threads 79 and a free end 168 which taper to form a reduced diameter 180. There are gaps 174 between the adjacent fingers 164 to accommodate the ribs 100 of the cable-grasping sleeve 100. The taper 184 of the ribs 171 terminates in a collar 182.

Figure 7:
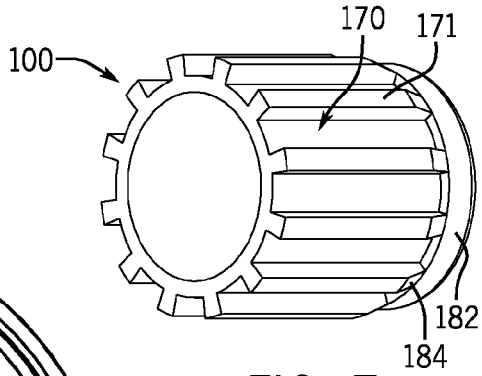
FIG. 7 is an isometric view of the cable grasping sleeve.

Referring to FIG. 7, the collar 182 extends radially outward from the cylindrical surface 170 of the cable-grasping sleeve 100. The diameter of this collar 182 is such that when the fingers 164 of the housing 120 are mated with the cable-grasping sleeve 100, as shown in FIG. 5, there outer surfaces 180 are radially inward of this diameter and their free ends 168 are axially immediately adjacent to this collar 182.

Figure 10:
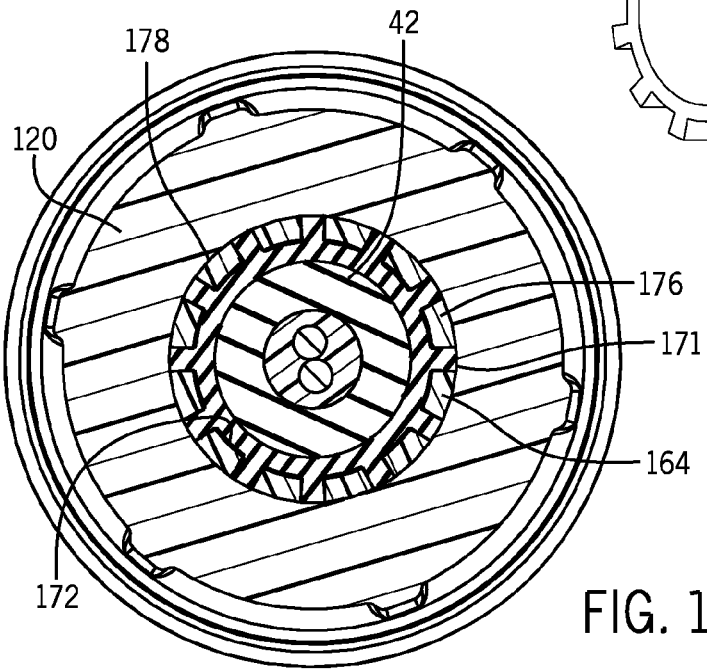
FIG. 10 is a cross section of FIG. 9 along section line 10-10.
Figure 8:
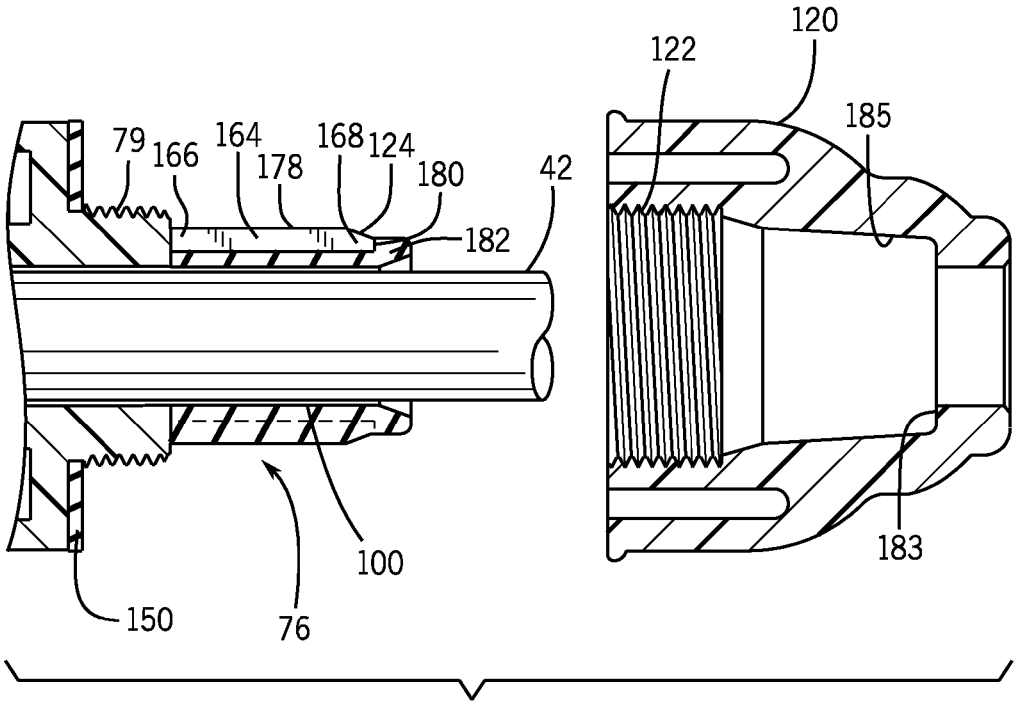
FIG. 8 is a cross section of the exterior end of a housing that is a part of a cable connector housing structure and an end cap adapted to be threaded on this end.
Figure 9:
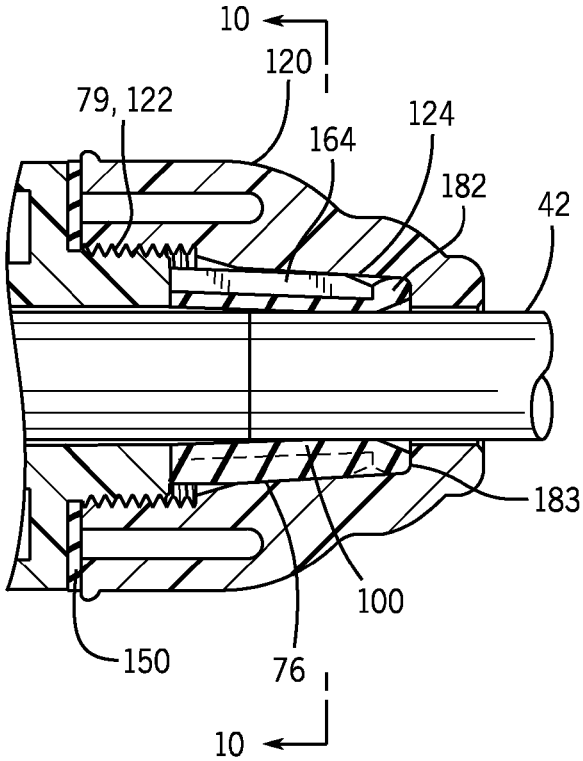
FIG. 9 is a cross section of the exterior end of a housing that is a part of a cable connector housing structure with the end cap threaded onto it.

Referring to FIGS. 8 and 9, one embodiment involves interaction between the end cap 120, the fingers 164 and the cable-grasping sleeve 100 firmly grasp a cable segment 42 and to provide a watertight seal around it. Before the female threads 122 of the end cap 120 engage the male threads 79 of the female housing 70 the outer surface of the fingers 164 define a diameter 178 when not at the taper at the free end 168 where a smaller diameter 180 is defined. The end cap 120 is provided with a collar 183 and a taper 185 on its bore. When the two threads 79 and 122 fully engage the fingers 164 are levered inward from their secured ends 166 so that their free ends press into the cable-grasping sleeve 100 causing it to firmly grasp the cable segment 42 and its collar 182 to assume an O-ring configuration seated against the ledge 183 of the end cap 120. FIG. 10 is a cross section along line 10-10 of FIG. 9 that also shows the cable grasping assembly engaging the cable segment 42. The outer surfaces 176 of the fingers 164 define a diameter 178 to which the ridges 171 conform.

Figure 11:
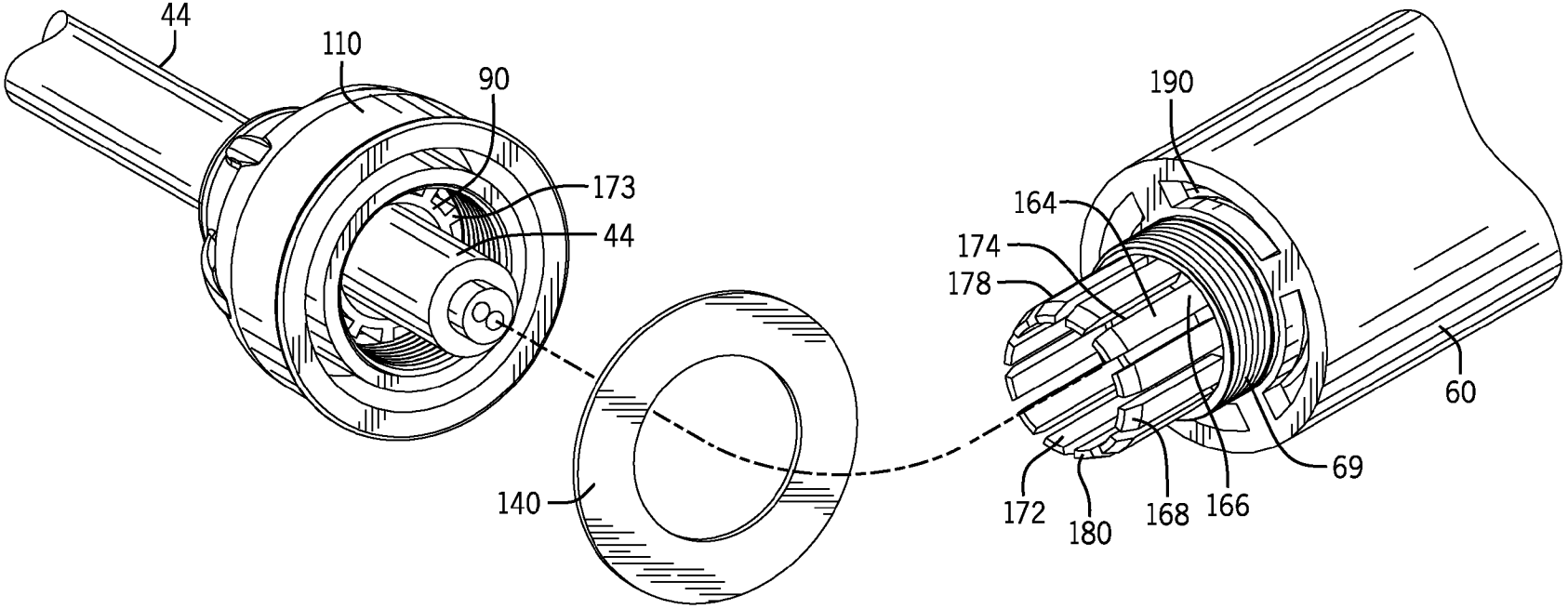
FIG. 11 is an isometric view of the exterior end of a housing that is a part of a cable connector housing structure and an end cap adapted to be threaded on this end.

Referring to FIG. 11, one embodiment involves a cable grasping assembly involving the male housing 60. It has fingers 164 with secured ends 166, free ends 168 and gaps 174. The secured ends 166 project out from the male threads 69 and provide a first diameter 178. The free end 168 provide a second, smaller diameter 180. The housing 60 has molding apertures 190 which facilitate the molding of the housing 60 and are sealed by the rubber washer 140 when the end cap 110 has been secured to the housing 60 by the male threads 69. The fingers 164 define a cavity 172 that accommodates the cable-grasping sleeve 90 with the exception of its ridges 173, which are accommodated by the gaps 174. When secured together the assembly firmly grasps the cable segment 44 and provides a watertight seal around it.

Figure 12:
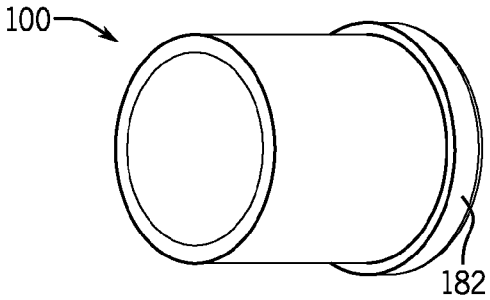
FIG. 12 is an isometric view of an alternative cable grasping sleeve.

Referring to FIG. 12, in one embodiment the female housing cable sleeve 100 has a cylindrical outer surface and a collar 182.

Figure 13:
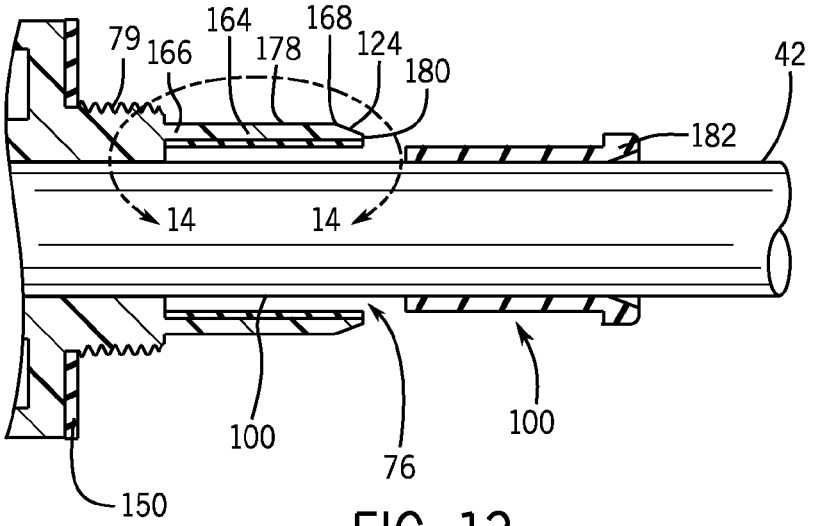
FIG. 13 is a cross section of an alternative exterior end of a housing that is a part of a cable connector housing structure and the alternative cable grasping sleeve.
Figure 14:
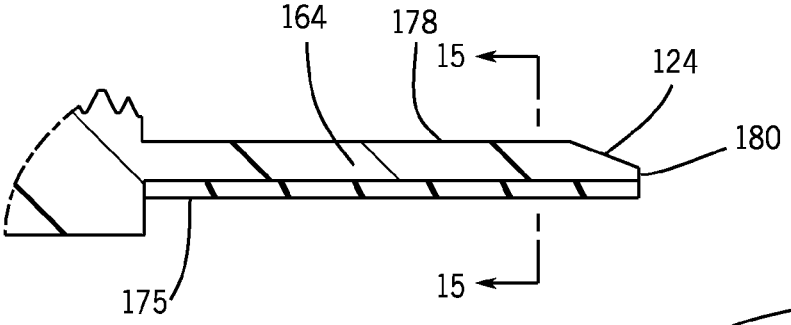
FIG. 14 is an exploded view along line 14-14 of a finger shown in FIG. 13.
Figure 15:
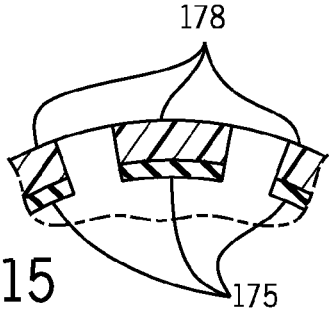
FIG. 15 is a cross section along line 15-15 of FIG. 14.

Referring to FIGS. 13-15, one embodiment involves the fingers 164 having an inner surface 175 especially adapted to interact with the female housing cable sleeve 100 with a cylindrical outer surface. In one embodiment the sleeve 100 and the inner finger surface 175 are both a rubbery material. In one embodiment the sleeve 100 has a very high coefficient of static sliding friction with the inner surface 175 of the fingers 164, similar to that observed between two flat pieces of common rubber.

One embodiment involves constructing the sleeve 100 out of a heat shrinkable material. In this embodiment the sleeve 100 may be secured to the cable segment 42 by the application of heat.

One embodiment involves a composite cable grasping sleeve in which a cylindrical sleeve inner component is initially heat shrunk onto a cable segment and then an outer sleeve component with radial ribs like that illustrated in FIG. 7 is placed over the inner component. Either the inner component or the outer component may carry a collar 182.

In one embodiment, one or more of the elements of the housing structure 50 are fabricated from a thermoplastic material. In one embodiment the thermoplastic material is injection molded to yield one or more of the elements. In one embodiment, the housings 60 and 70, the end caps 110 and 120 and the locking sleeve 130 are fabricated from thermoplastic materials. In one embodiment the cable grasping sleeves 90 and 100 are fabricated from an elastomeric material.

In one embodiment, the housing 50 facilitates connecting cable segments 42 and 44 which run from the robotic cleaning vehicle 20 and the electrical power source 30, respectively, such that the segments 42 and 44 may rotate with respect to each other, with a water tight connection that can be submerged in the liquid in which the vehicle 20 is submerged. In one embodiment, one cable segment is terminated with a classical stereo jack and the other is provided with a classical stereo socket such that when the jack is inserted in the socket two circuit paths two circuit paths are created. These two segments 42 and 44 are inserted through apertures in the end caps 110 and 120 into the cable support structure 62 and 72 of housings 60 and 70, respectively, such that when the inner bore ends 65 and 75 are brought into contact with each other the jack seats within the socket to create two circuit paths. The end caps 110 and 120 are screwed onto their respective housings 60 and 70 and their inclined surfaces 114 and 124, respectively, cause a decrease in the diameter of the cable grasping sleeves 90 and 100 causing them to grasp the cable segments 44 and 42. The male housing 60 is partially inserted into the female housing 70 until the ends 65 and 75 of the inner bores 64 and 75 touch and the protuberances 71 of the female housing 70 seat in the detents 61 of the male housing 60. The locking sleeve 130 is moved into locking position so that it covers the protuberances 71 of the female housing 70 and the protuberance which it carries seats in a detent 61 in the male housing 60 through a slot in the female housing 70. The two cable segments 42 and 44 are now securely held together against any axial separation force but are free to rotate with respect to each other. In one embodiment, the release tab of the locking sleeve 130 is used to disengage the protuberance of the locking sleeve from its detent 61 in the male housing 60 and the locking sleeve 130 is moved into an unlocked position so it no longer covers the protuberances 71. An axial separating force is applied which causes the protuberances 71 of the female housing 70 to be drawn out of the detents 61 of the male housing 60 by their sloped rear surfaces 73 and the male housing 60 is withdrawn from the female housing 70. In this way the two cable segments 42 and 44 are separated from each other and the stereo jack is withdrawn from the stereo socket.

While only certain features of the invention have been illustrated and described herein, many modifications and changes will occur to those skilled in the art. It is, therefore, to be understood that the appended claims are intended to cover all such modifications and changes as fall within the true spirit of the invention.

What is claimed is:

1. A cable grasping assembly comprising:

an end cap with a bore with a decreasing diameter from one end to the other comprising:

a screw thread on the interior surface of the bore; and a ledge which projects inward from the interior surface of the bore adjacent to the end with the smallest diameter;

a cable holding sleeve constructed of a readily compressible material comprising:

a generally circular bore which extends over its axial length; and a collar at one end beyond an axial terminus of ridges which extend radially from the outer surface of the cable holding sleeve; and a housing with an interior bore for accommodating a cable comprising:

a series of fingers which extend from one end of the housing with gaps between them to accommodate the ridges of the cable holding sleeve and which have an axial length such that their free ends terminate at the collar of cable holding sleeve; and a screw thread on the exterior surface of the housing and spaced from the free end of the fingers.

2. The cable grasping assembly of claim 1 wherein the free ends of the fingers have a taper inward toward the interior bore of the housing.

3. The cable grasping assembly of claim 1 wherein the bore of the end cap has a taper moving from larger to smaller proceeding away from the screw thread on its interior surface such that the fingers will compress the cable holding sleeve when the end cap screw thread engages the housing screw thread and the screw thread is at the end of the end cap at which the bore has its largest diameter.

4. The cable grasping assembly of claim 3 wherein the taper of interior surface will cause the fingers to compress the collar of the cable holding sleeve into the form of an O-ring lodged against the ledge of the end cap when the end cap screw thread engages the housing screw thread.

5. The cable grasping assembly of claim 1 wherein the cable holding sleeve has a series of ridges which extend radially from its outer surface and which extend axially over a significant portion of its axial length.

6. The cable grasping assembly of claim 5 wherein the ribs of the cable holding sleeve have a taper at their ends adjacent to the collar of the cable holding sleeve which matches that of the free ends of the fingers.

7. The cable grasping assembly of claim 1 wherein the cable holding sleeve is constructed of a heat shrinkable elastomeric material.

8. A waterproof lockable disengaging swiveling electrical cable connector housing structure comprising:

a first housing having a first end and an opposing second end, a cable support structure located within its bore at the first end for receiving a first electrical cable segment;

a second housing having a first end and an opposing second end, a cable support structure located within its bore at the first end for receiving having a second electrical cable segment; and a locking sleeve operatively slidingly secured to the second housing and movable from a first position to a second position to lock the first housing to the second housing, such that the first housing is rotatable relative to the second housing when the locking sleeve is in the locked position, a cable grasping assembly at the opposing second end of each housing comprising:

a cable holding sleeve having a series of ridges, and an interior bore formed in the second end of each housing for accommodating a respective end of a cable, and a series of fingers which extend from each second end of each housing with gaps between them to accommodate the ridges of the corresponding cable holding sleeve and which have an axial length such that their free ends terminate at a collar of the cable holding sleeve.

9. A waterproof lockable disengaging swiveling electrical cable connector housing structure comprising:

a first housing having a cable support structure located within its bore for receiving a first electrical cable segment;

a second housing having a cable support structure located within its bore for receiving having a second electrical cable segment; and a locking sleeve operatively slidingly secured to the second housing and movable from a first position to a second position to lock the first housing to the second housing, such that the first housing is rotatable relative to the second housing when the locking sleeve is in the locked position, wherein each housing has a cable grasping assembly comprising:

an end cap with a bore with a decreasing diameter from one end to the other comprising:

a screw thread on the interior surface of the bore; and a ledge which projects inward from the interior surface of the bore adjacent to the end with the smallest diameter;

a cable holding sleeve constructed of a readily compressible material comprising:

a generally circular bore which extends over its axial length;

a series of ridges which extend radially from its outer surface and which extend axially over a significant portion of its axial length; and a collar at one end beyond the axial terminus of the ridges which extends radially from the outer surface of the sleeve; and the housing with an interior bore for accommodating a cable comprising:

a series of fingers which extend from one end of the housing with gaps between them to accommodate the ridges of the cable holding sleeve and which have an axial length such that their free ends terminate at the collar of cable holding sleeve; and a screw thread on the exterior surface of the housing and spaced from the free end of the fingers.

10. A waterproof lockable disengaging swiveling electrical cable connector housing structure comprising:

a first housing having a cable support structure located within its bore for receiving a first electrical cable segment;

a second housing having a cable support structure located within its bore for receiving having a second electrical cable segment; and a locking sleeve operatively slidingly secured to the second housing and movable from a first position to a second position to lock the first housing to the second housing, such that the first housing is rotatable relative to the second housing when the locking sleeve is in the locked position, wherein the first housing is a male housing which is partially insertable into the bore of the second housing, each housing comprising a generally cylindrical body having:

an interior cylindrical recess to accommodate a cable grasping sleeve, the recess being located adjacent to the end of the housing distal from the end involved in the partial insertion;

an engagement structure for engaging a reciprocal engagement structure on the other housing in such a way that the two housings are free to rotate about the cylindrical surfaces of each other when locked together via their engagement structures and the locking sleeve; and a mechanism for affixing an end cap over the exterior surface of the housing located adjacent to the end of the housing carrying the recess for a cable sealing sleeve;

the locking sleeve is manually moveable into and out of interaction with the engagement structures of the two housings such that as a result of the interaction they are locked into engagement and in this locked configuration do not allow axial movement between the two housings: and the housing structure also has:

a sealing structure carried by one of the housings which establishes a water tight seal between them when the first housing is partially inserted into the second;

a cable grasping sleeve seated in its recess in each housing and constructed of a compressible material; and two end caps, each with a mechanism which interacts with the mechanism on one of the housings to affix the end cap to the housing in such a way that the interior diameter of the cable grasping sleeve seated in the housing is decreased and each end cap having an aperture which aligns with the cable support structure located within the bore of its housing.

11. The cable connector structure of claim 10 wherein the locking sleeve carries one or more protuberances which engage one or more detents in the outer surface of the first housing.

12. The cable connector structure of claim 10 wherein the engagement structure carried by the first housing is one or more detents and the engagement structure carried by the second housing is one or more protuberances.

13. The cable connector structure of claim 12 wherein second housing carries a plurality of axially oriented slots running from the end carrying the protuberances.

14. The cable connector structure of claim 13 wherein protuberances of the locking sleeve access detents of the first housing via one or more of the axially oriented slots in the second housing.

15. The cable connector structure of claim 10 wherein the sealing structure creating a watertight seal between the male housing and the female housing is an X-ring seal.

16. The cable connector structure of claim 10 wherein each housing is affixed to the end of an electrical cable segment, one end carries a stereo jack structure, one end carries a stereo socket structure and the cable support structure of each housing is configured to support the cable segment end inserted into it.

17. The cable connector structure of claim 8 wherein the cable support structure of each housing comprises at least two inner bores of decreasing diameter progressing from proximate to distal from the end cap and the smallest inner bore of each housing is aligned with that of the other housing and the end of each such bore distal from the end cap of its housing is immediately adjacent to the similarly situated end of the other bore.

18. A waterproof lockable disengaging swiveling electrical cable connector housing structure comprising:

a male housing partially inserted into the bore of a female housing having one or more axial slots through it, each housing constructed of an injection moldable thermoplastic material comprising a generally cylindrical body having:

a cable support structure located within its bore comprising at least two inner bores of decreasing diameter progressing from proximate to distal from the end not involved in the insertion and the smallest inner bore of each housing is aligned with that of the other housing and the end of each such bore proximate to the end of its housing involved in the insertion is immediately adjacent to the similarly situated end of the other bore;

an interior cylindrical recess to accommodate a cable grasping sleeve, the recess being located adjacent to the end of the housing distal from the end involved in the partial insertion;

one or more protuberances carried by the female housing which engage one or more detents carried by the male housing in such a way that the two housings are free to rotate about the cylindrical surfaces of each other when locked together via these protuberances and detents and a locking sleeve; and a screw thread for affixing an end cap over the exterior surface of the housing located adjacent to the end of the housing carrying the recess for a cable grasping sleeve;

an X-ring carried by one of the housings which establishes a water tight between them when the male is partially inserted into the female;

a cable holding sleeve seated in its recess in each housing and constructed of a corrugated compressible material;

two end caps, each with a screw thread which interacts with the screw thread on one of the housings to affix the end cap to the housing in such a way that the interior diameter of the cable grasping sleeve seated in the housing is decreased and each end cap having an aperture which aligns with the cable support structure located within the bore of its housing; and a locking sleeve which slides on the outside surface of the female housing in the axial direction into and out of a locking position in which it retains the protuberances of the female housing in the detents of the male member so as to prevent axial movement between the two housings, carries one or more protuberances which engage one or more detents in the male housing via the slots in the female housing when it is in a locking position such that the protuberances may not dislodged from the detents by axial motion and carries a tab for lifting its protuberances out of the detents of the male housing.

19. The cable connector structure of claim 18 wherein each housing and end cap is part of a cable grasping assembly comprising:

the end cap which has:

a bore with a decreasing diameter from one end to the other;

a screw thread on the interior surface of the bore; and a ledge which projects inward from the interior surface of the bore adjacent to the end with the smallest diameter;

the cable holding sleeve which has:

a generally circular bore which extends over its axial length;

a series of ridges which extend radially from its outer surface and which extend axially over a significant portion of its axial length; and a collar at one end beyond the axial terminus of the ridges which extends radially from the outer surface of the sleeve; and the housing which has:

a series of fingers which extend from one end of the housing with gaps between them to accommodate the ridges of the cable holding sleeve and which have an axial length such that their free ends terminate at the collar of cable holding sleeve; and a screw thread on the exterior surface of the housing and spaced from the free end of the fingers.

20. The cable connector structure of claim 18 wherein the cable holding sleeves are constructed of an elastomeric material.

* * * * *